US006952996B2

(12) United States Patent
Sisk et al.

(10) Patent No.: US 6,952,996 B2
(45) Date of Patent: Oct. 11, 2005

(54) REMOTELY OPERATED MANHOLE COVER FOR A TANKER

(75) Inventors: David E. Sisk, Bonne Terre, MO (US); Roger L. Breakfield, Potosi, MO (US); William Spencer, Kansas City, MO (US); Scott A. Finnell, Parkville, MO (US)

(73) Assignee: Delaware Capital Foundation (Dela.Corp.), Wilmington, DE (US)

( * ) Notice: Subject to any disclaimer, the term of this patent is extended or adjusted under 35 U.S.C. 154(b) by 385 days.

(21) Appl. No.: 10/190,007

(22) Filed: Jul. 8, 2002

(65) Prior Publication Data

US 2002/0190068 A1 Dec. 19, 2002

Related U.S. Application Data

(63) Continuation-in-part of application No. 10/040,593, filed on Jan. 7, 2002.

(60) Provisional application No. 60/260,406, filed on Jan. 9, 2001.

(51) Int. Cl.[7] ..... B16D 39/00

(52) U.S. Cl. ..... 105/377.01; 105/377.06; 105/282.2

(58) Field of Search ..... 105/358, 377.01, 105/377.05, 377.06, 377.07, 377.08, 280, 282.2

(56) References Cited

U.S. PATENT DOCUMENTS 4,854,076 A * 8/1989 Sieben et al. ..... 49/280
5,366,317 A 11/1994 Solimar
5,937,581 A * 8/1999 Matye et al. ..... 49/279
6,293,051 B1 * 9/2001 Matye ..... 49/395

OTHER PUBLICATIONS

KNAPPCO "LM 20 Inch Pressure Manhole" Specification Sheets 2 pages.

* cited by examiner

*Primary Examiner*—S. Joseph Morano
*Assistant Examiner*—Robert J. McCarry, Jr.
(74) *Attorney, Agent, or Firm*—Paul M Denk

(57) ABSTRACT

A remotely operated manhole cover for a tanker, trailer, or other storage unit is provided. The manhole cover includes a hollow neck which is welded in place in the shell of the tanker or trailer. The neck defines an opening which allows access to the interior of the tanker or trailer for filling or cleaning of the tanker. A lid is pivotable about an axis between a closed position in which the manhole cover is closed, and an open position in which the lid is clear of the neck opening to allow access to the interior of the tanker. The lid is provided with an inflatable seal and locking flanges which extend from a rim of the lid. Movable locking members are provided on the neck and are movable between a locked position in which locking member engages the lid locking flange and an unlocked position in which the locking members are disengaged from the lid locking flange. Separate actuators are provide for the cover and the locking members. A control unit is provided to energize the cover and locking member actuators and to inflate and deflate the seal. The control unit activates the locking member and lid actuators and inflates or deflates the seal in sequence to unlock and open the lid or to close and lock the lid. The control unit includes a manually operable switch assembly which activates the manhole cover to open and close the lid. The switch assembly is located remote from the manhole cover, and preferably near the bottom of the tanker.

18 Claims, 9 Drawing Sheets

REMOTELY OPERATED MANHOLE COVER FOR A TANKER

CROSS-REFERENCE TO RELATED APPLICATIONS

This application is a continuation-in-part of application Ser. No. 10/040,593, filed Jan. 7, 2002, entitled "Remotely Operated Manhole Cover For A Tanker", which, in turn, claims priority to Provisional Application Ser. No. 60/260,406 entitled "Remotely Operated Manhole Cover For A Tanker" and filed Jan. 9, 2001, both of which are incorporated herein by reference.

STATEMENT REGARDING FEDERALLY SPONSORED RESEARCH OR DEVELOPMENT

Not Applicable.

BACKGROUND OF THE INVENTION

This invention relates to manhole covers for tanker cars, and in particular, to an automatic manhole cover.

Manhole covers are known for providing an inlet into a structure, such as a trailer tanks which hold particulate matter (i.e., grain, plastic pellets, flour, cement, sugar, etc.) as well as liquids.

The manhole covers typically provided on rail road tankers and truck trailers are manually operated covers. They include a series of cam operated levers which surround the manhole cover and are operable to lock and unlock the cover. To open and close prior manually operated manhole covers, someone must climb onto the tanker using a ladder at the back of the tanker. Then, he must walk along a catwalk which extends the length of the tanker until he reaches the manhole cover. To reach the manhole cover, and to provide enough leverage to operate the locks, the worker must step on the tanker shell itself. Working on top of a tanker can be precarious and exposes the worker to a risk of falling. The risk of falling increased if the tanker is wet or icy.

Further, the manual locks which hold the tank cover closed can be difficult to open. Again, the difficulty in opening the tank cover can be increased if the locks are, for example, frozen. This difficulty in operating the manual locks can increase the risk of falling.

Thus, it is desirable to not only make manhole covers easier to open and close, but to enable workers to remotely open and close manhole covers (i.e., from the ground).

BRIEF SUMMARY OF THE INVENTION

Briefly stated, a remotely operated manhole cover assembly for a storage tank, such as a mobile tanker or a stationary storage unit. The tank has a shell defining a chamber which receives flowable materials and an opening in the shell which is closed by the manhole cover assembly. The cover assembly includes a cover or lid pivotal about an axis of rotation between a closed position in which the cover closes the tank opening and an open position in which the cover is substantially clear of the tank opening. A pneumatic locking assembly is provided to maintain the cover or lid in its closed position. The locking assembly includes a first portion mounted to the cover and a second portion mounted to the tank shell. The locking assembly is movable between a locked position in which the first and second portions are engaged to hold the cover in its closed position and an unlocked position in which the first and second portions are disengaged to allow the cover to be moved to its opened position. An inflatable/deflatable seal is also provided to form a seal between the cover lid and the tanker when the lid is closed.

A pneumatic cover actuator is operatively connected to the cover to move the cover between its opened and closed positions. Similarly, a pneumatic lock actuator is operatively connected to the locking assembly to move the locking assembly between its locked and unlocked position. The actuators could also be hydraulic actuators. Alternatively, one of the actuators could be a hydraulic actuator and one could be a pneumatic actuator. Additionally, a valve is disposed in a pressurized air line between a source of pressurized air and the seal. The valve is movable between a first position in which the seal can be inflated and a second position in which the seal can be deflated.

The cover assembly includes a cover shaft or axle to which the cover is mounted and which defines the axis of rotation for the cover. A torsion spring is operatively connected to the shaft and imparts a force to the cover when the cover is in its closed position and when the cover is in its opened position. The torsion spring is mounted to the cover shaft such that the torsion spring is in an unloaded state when the cover is rotated approximately 90°.

A control unit is provided to control or operate the seal valve and the actuators. The control unit includes a CPU which is in operative communication with the seal valve and the actuators to control them and a switch. The switch, when activated, causes the CPU to enter an open cycle in which the CPU activates the cover activator, the lock activator, and the seal valve in sequence to deflate the seal, unlock the cover, and open the cover, or a close cycle in which the CPU activates the cover activator, the lock activator, and the seal valve in sequence and to close the cover, lock the cover, and inflate the seal. The switch can be a remote control switch which sends and IR signal to the controller, or a switch which is wired to the controller.

The control unit includes a seal sensor in communication with the inflatable/deflatable seal which emits a signal indicative of the pressure within the seal. This seal pressure signal is received by the CPU to enable the CPU to monitor the seal pressure.

The control unit also includes a cover position sensor to monitor the position of the cover. The cover position sensor, which is preferably a potentiometer, but can be other another type of sensor, outputs a signal indicative of the radial position of the cover which is received by the control unit. The control unit uses the information from the cover position sensor to monitor the radial position of the cover. Additionally, the control unit operates the speed and acceleration of the cover during the movement of the cover from the opened to the closed position. The controller controls the movement of the cover based on the speed and/or acceleration information provided by the cover position sensor.

The control unit also includes pressure sensors to monitor the pressure in the control lines for the actuators. If both actuators are hydraulic, or both are pneumatic, a single sensor can be provided. However, if one is hydraulic and one is pneumatic, two sensors will be required. The control line sensors output a signal to the CPU indicative of the pressure within the control lines.

A locking assembly sensor is also provided. The locking assembly sensor emits a lock position signal which is received by the CPU and is indicative of the position of the locking assembly. The CPU controls the cover actuator based on the lock signal, such that, the CPU aborts an open cycle if, after signaling the lock actuator to move the locking assembly to the unlocked position, the lock signal indicates that the locking assembly is still in the locked position.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes what I presently believe is the best mode of carrying out the invention. Although the invention is described for use in conjunction with a tanker (such as a trailer tanker), the invention has applicability to any storage tank, whether that storage tank be part of a trailer tanker, a railroad tanker, a ship tanker, or an above ground or underground storage tank.

A tanker T includes a shell 3 which defines a chamber into which transportable material (i.e. particulates, liquids, or gases) are loaded for transportation. The tanker T includes at least one manhole assembly 5 of the present invention at its top which can be opened to allow material to be transported to be loaded into the tanker or to clean the tanker. The tanker T also includes hopper outlets H at its bottom to allow the material to be unloaded from the tanker. The hoppers H do not form a part of the invention, and can be any desired type of hopper outlet. Although the tanker T is shown to be a trailer tanker, the manhole cover 5 of the present invention could also be used in conjunction with a railroad tanker, a tanker ship, storage tanks, or other types of tanks which are used to hold and store or transport material.

Figure 2:
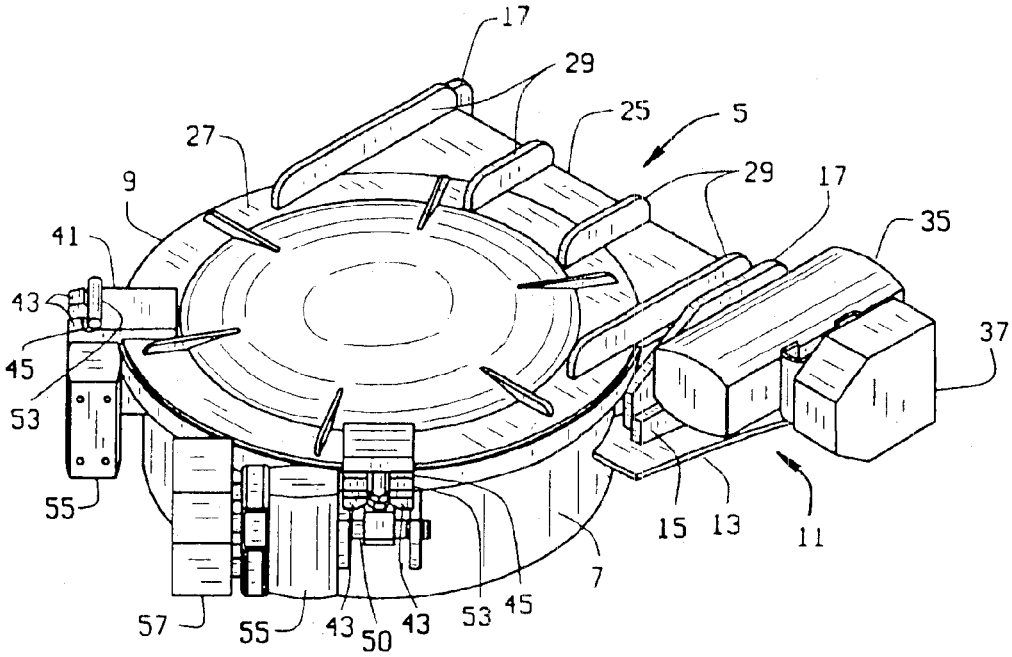
FIG. 2 is a perspective view of the manhole cover when closed.
Figure 3:
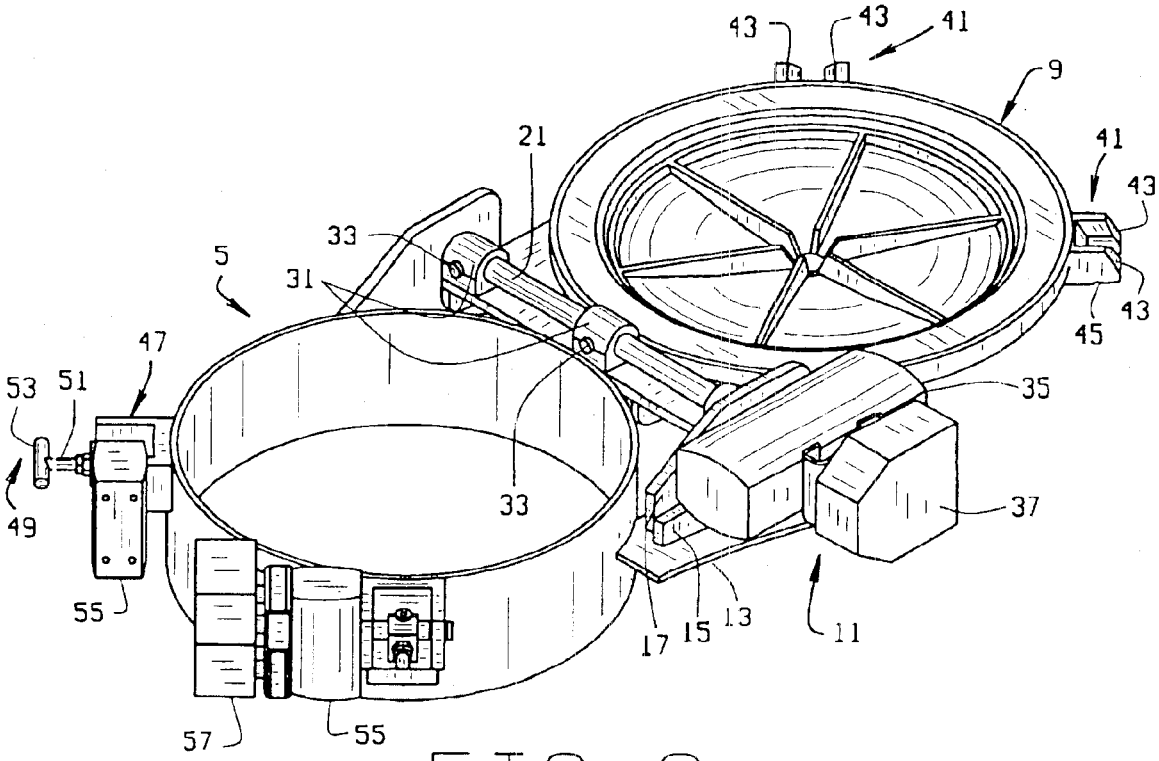
FIG. 3 is a perspective view of the manhole cover when opened.
Figure 4:
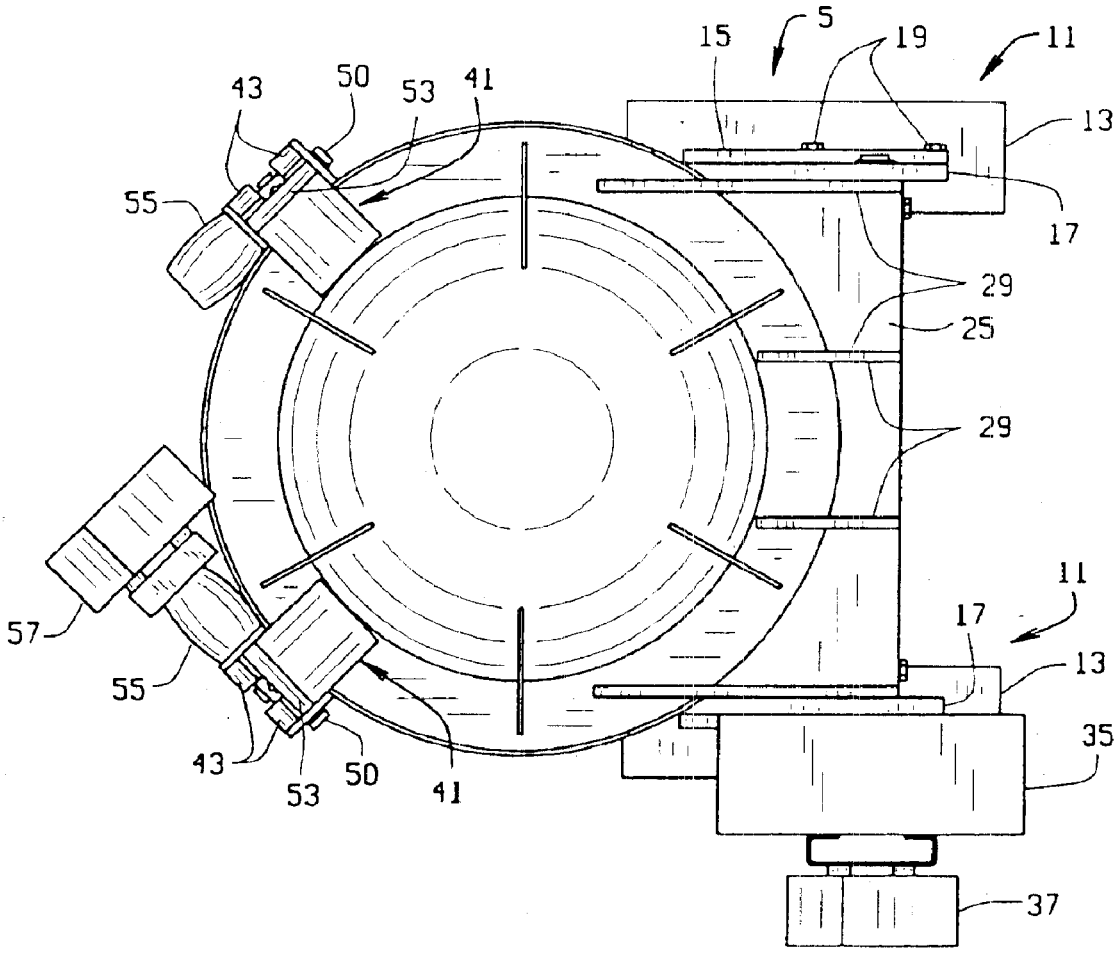
FIG. 4 is a top plan view of the manhole cover.
Figure 7:
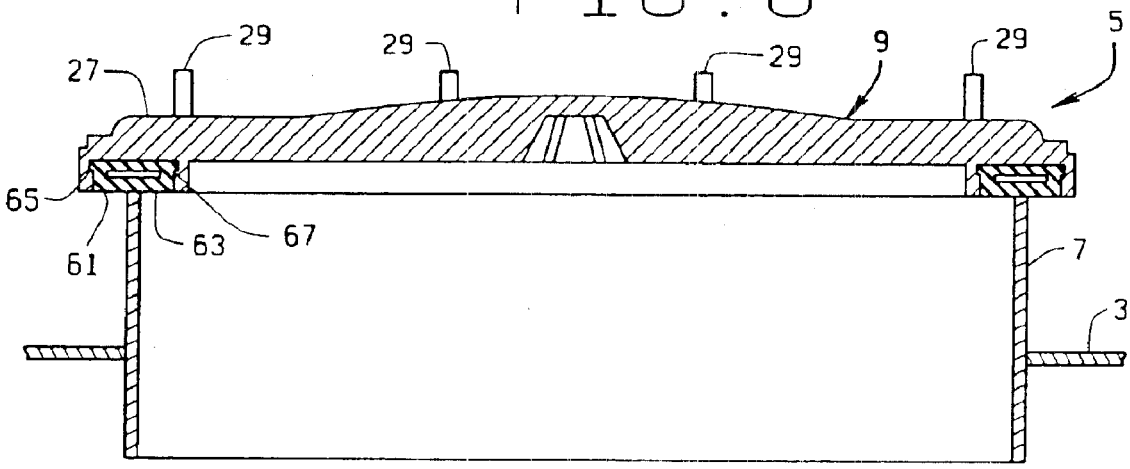
FIG. 7 is a cross-sectional view of the manhole cover taken along line 7—7 of FIG. 5 but with the actuating members removed for clarity, showing an inflatable seal in a deflated state.

In a first illustrative embodiment, the manhole cover assembly includes a neck or weld ring 7, which, as best seen in FIG. 7, is received in an opening in the tanker shell 3. The weld ring 7 is in the form of a cylinder which extends through the tanker shell 3 and which is welded in place to the tanker shell to define an opening into the tanker chamber. A cover 9 is hingedly mounted to the manhole cover assembly 5 to be selectively movable between a closed position (as shown in FIG. 2) in which it covers the weld ring 7 to prevent access into the tanker, and an open position (as shown in FIG. 3) in which the cover is clear of the weld ring, the weld ring is opened, and materials can be loaded into the tanker, or workers can enter the tanker to, for example, clean the tanker.

Figure 5:
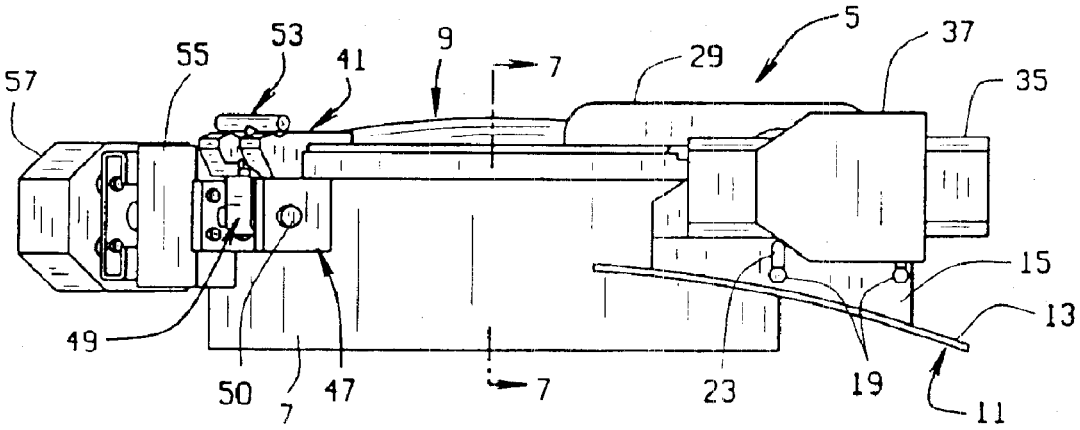
FIG. 5 is a side elevational view of the manhole cover.

A pair of brackets 11 extend rearwardly from the weld ring 7. The brackets 11 each include a base plate 13 which rests on the tanker shell 3 and an arm 15 extending up from the plate 13. A second arm 17 is mounted to the bracket arm 15 by bolts 19. A shaft 21 extends between the arms 17 and is mounted in the arms 17 to be rotatable. The arm 15 includes slots 23 (FIG. 5) through which the bolts 19 extend to allow for slight adjustment of the vertical position of the shaft 21 during assembly of the manhole cover assembly 5. Thus, the vertical position of the shaft 21 can be adjusted relative to the weld ring 5, to ensure that the cover 9 will properly close the neck 7.

Figure 6:
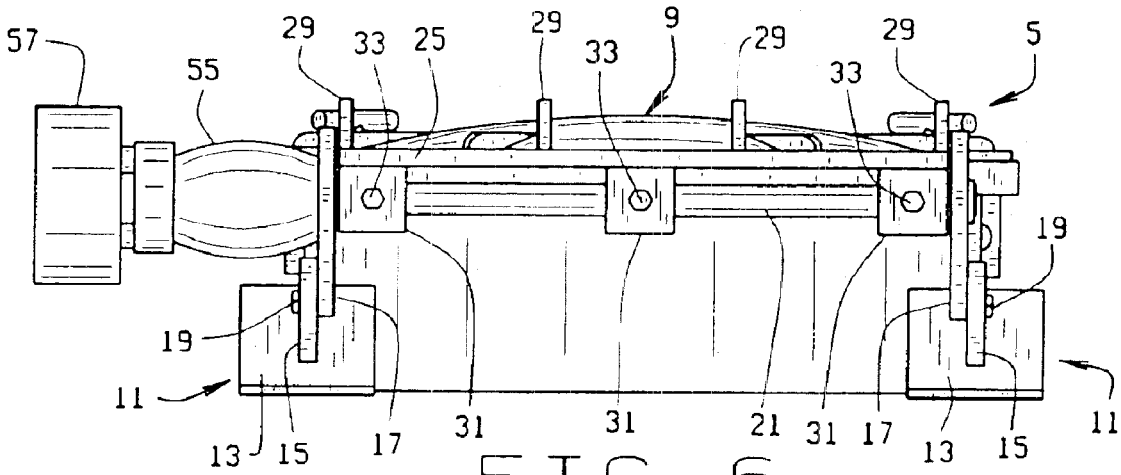
FIG. 6 is a rear view of the manhole cover.

The cover 9 includes a mounting flange 25 which extends rearwardly from the rim 27 of the cover 9. A plurality of ribs 29 extend over an upper or outer surface of the cover rim 27 and flange 25. As seen in FIGS. 3 and 6, the mounting flange 25 includes journals 31 through which the shaft 21 extends. The journals are fixed to the shaft 21 by bolts 33 which extend radially through the journals 31 and through the shaft 21. Thus the cover 9 and shaft 21 will rotate together, and the shaft 21 defines an axis of rotation for the cover 9.

A cover actuator 35 is mounted to the bracket 11 above the arm 15, adjacent the outer surface of the arm 17 to drive the shaft 21. As will be described below, activation of the actuator 35 will cause the actuator to rotate the shaft 21 and hence move the cover 9 between the open and closed positions. A limit switch 37 is mounted to, and operatively connected to, the actuator 35. The actuator 35 is preferably a pneumatic piston. The piston rod is connected to the shaft 21 by a link (not shown). Hence, extension and retraction of the piston rod will rotate the shaft 21. Alternatively, the piston could be mounted to the tanker shell 3 with its rod operatively connected to the cover rim 27, such that, upon extension and retraction of the piston rod, the cover 9 is moved between its open and closed positions.

To lock the cover 9 in its closed position, the cover 9 includes a pair of locking flanges 41 which extend out from the cover rim 27. Each locking flange 41 includes a pair of spaced apart arms 43 having a groove or detent 45 formed in the upper surface of the arms 43. The grooves 45 are spaced radially outwardly of the edge of the cover rim 27. A lock bracket 47 is mounted to the weld ring 3 to be below the locking flanges 41. The lock bracket 47 includes a pivotable T-member 49 having a stem 51 and a cross-bar 53. The T-member 49 is fixed to a shaft 50 which is rotatably mounted in the lock bracket 47. The T-member is thus movable between a locked position in which the cross-bar 53 is received in the groove 45 of the cover locking flange 41 and an unlocked position in which the T-member is disengaged from the cover locking flange 41. As can be appreciated, when the T-member engages the locking flange 41, pivotal movement of the cover will be prevented, and the cover 9 will be locked in a closed position. Each T-member 49 is moved between its locked and unlocked positions by its own actuator 55. A limit switch 57 is associated with only one of the actuators 55. However, the limit switch 57 is operably connected to both actuators 55. The actuators 55 are preferably pneumatic pistons. The piston rods are connected to the shafts 50 by a link. Hence, extension and retraction of the piston rod will rotate the shafts 50, causing the T-members 49 to pivot about the shafts 50.

Figure 8:
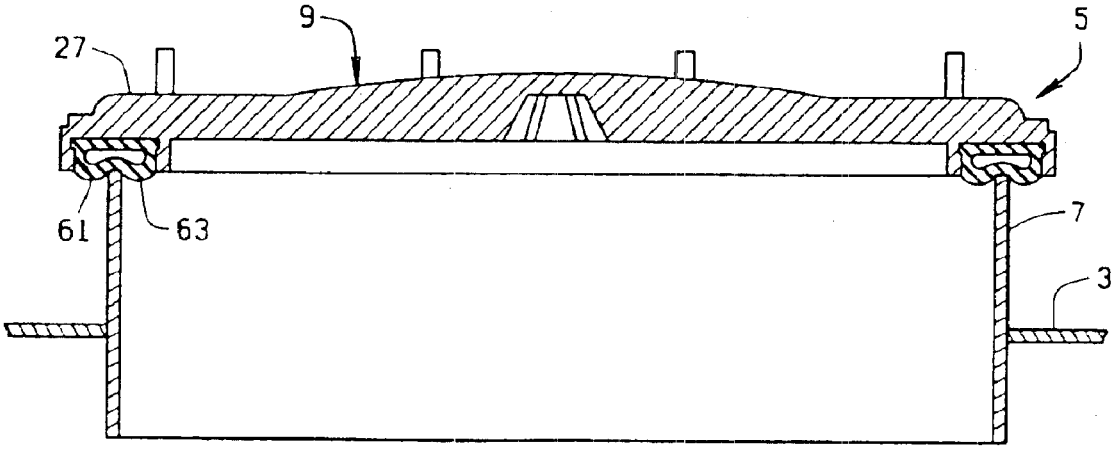
FIG. 8 is a view similar to FIG. 7, but showing the inflatable seal in an inflated state.

When the cover 9 is in its closed position, it is desirable to form a fluid and air tight seal between the cover 9 and the weld ring 3. To accomplish this, the cover 9 includes a circumferential channel 61 (FIGS. 7–8) in the underside of the cover rim 27. An inflatable annular seal 63 is received in the groove 61. The seal 63 is a hollow tube that is preferably made from a flexible, durable material, such as a nitrile. The seal 63 includes small flanges 65 extending around an inner and outer circumference of the seal near the top of the seal, giving the seal an overall appearance of a widened, flattened T. These flanges are received in small side grooves 67 in the channel 61. The flanges 65 and side groves 67 form a friction fit which holds the seal 63 in the channel 61. The seal 63 is connected to an air supply over an air line, and can be inflated and deflated. When the seal is deflated, as seen in FIG. 7, the seal is generally rectangular in cross-section. However, when the lid 9 is locked and the seal is expanded, as seen in FIG. 8, the seal 63 forms slight bumps on opposite sides of the weld ring 7. When the seal is inflated, an air and fluid tight seal is formed between the cover 9 and the weld ring 7. Additionally, as will be explained below, when the seal is inflated, the cover 9 is lifted slightly.

A junction box 71 (FIG. 1) is positioned adjacent the manhole assembly 5 and includes wiring to sequentially control the locking actuators 55, the cover actuator 35 and their associated limit switches, and the inflatable seal 63 to open and close the cover 9 and to lock and unlock the cover 9. The junction box 71 is connected to a control panel 73 which is at the base of the tanker T. A conduit 75 carries pneumatic and electrical lines between the control box and the junction box. The control panel 73 also includes connectors to connect the control box to a source of electricity 76 and a source of air, so that the cover can be operated.

Figure 1:
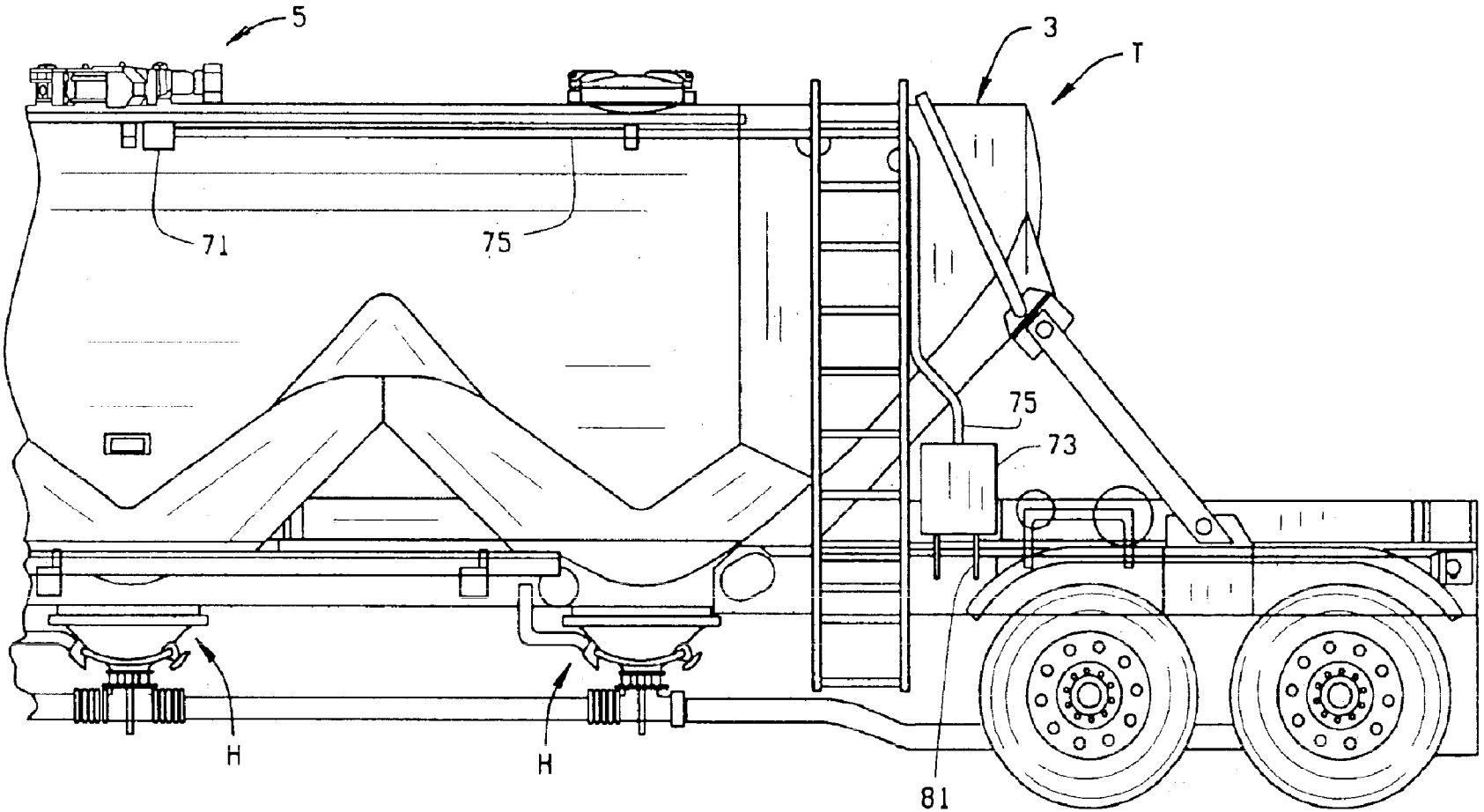
FIG. 1 is a fragmentary view of a tanker having a remotely operated manhole cover of the present invention.
Figure 9:
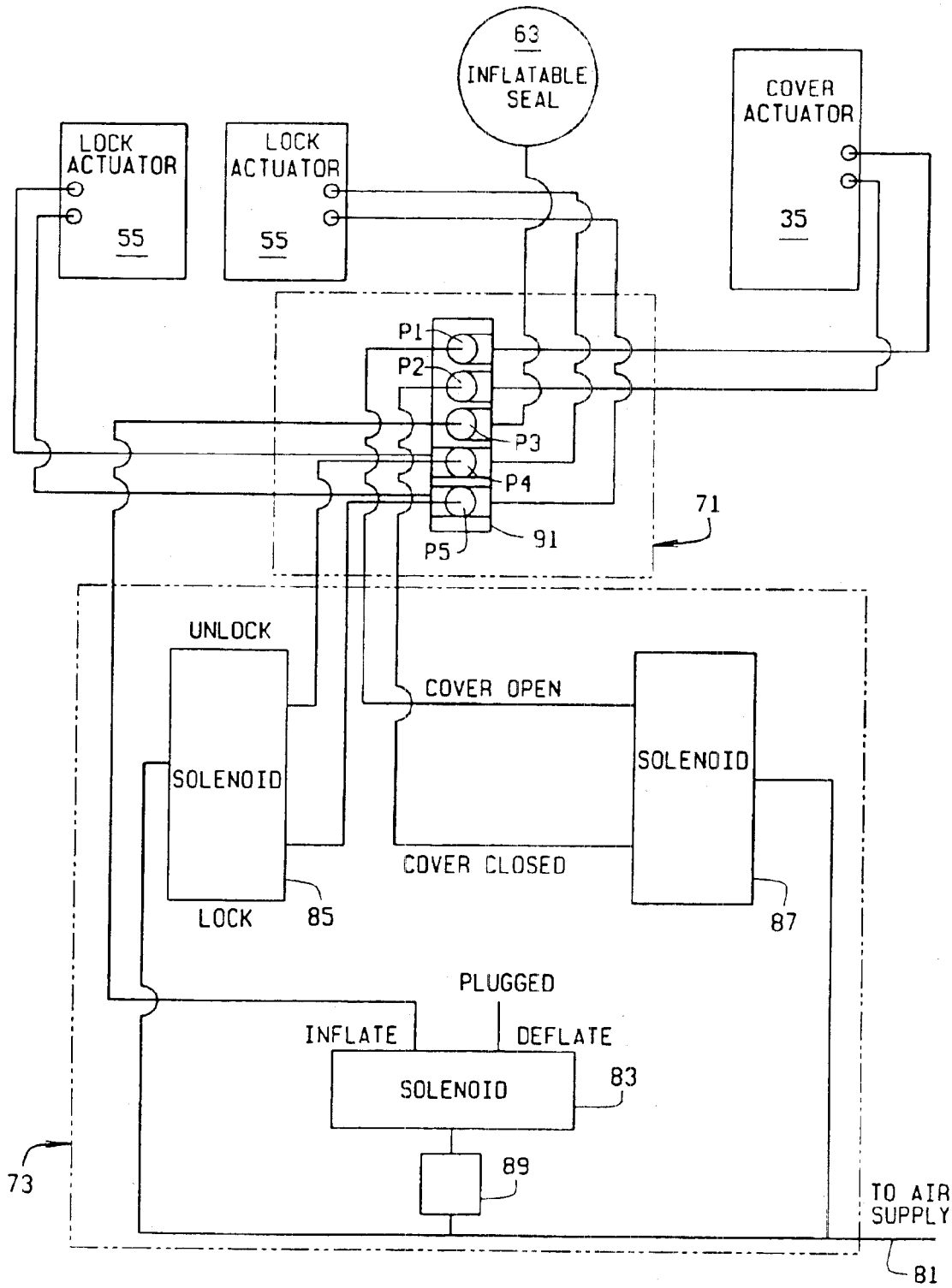
FIG. 9 is a schematic of the pneumatic system used to open and close the manhole cover as well as inflate and deflate the seal.

The pneumatic schematic is shown in FIG. 9. The control box 73 is connected to a supply of air over an air supply line 81. The supply air is directed to three valves: a valve 83 which controls the inflatable seal, a valve 85 which controls the cover locks, and a valve 87 which controls the cover 9. The valves 83, 85, and 87 are preferably spool valves which are movable between open and closed positions. Each spool valve has two associated activation solenoids. One solenoid moves the spool valve to its open position and the other solenoid moves the valve to its closed position. A pressure regulator 89 is placed in the line which leads from the supply line to the valve 83 which controls the seal. The outputs of the cover and lock valves 85 and 87 are connected to ports P1, P2 and P4 and P5 of a manifold 91, respectively. The one output of the seal valve 83 is connected to the port P3 of the manifold 91 and another output of the valve 83 is plugged. The manifold 91 is located in the junction box 71 in proximity to the weld ring and cover at the top of the tanker shell, and the valves 83, 85, and 87 are contained in the control box 73 at the base of the tanker. Thus, the five air tubes which connect the outputs of the valves 83, 85, and 87 to the manifold 91 are carried to the manifold 91 via the conduit 75 (FIG. 1).

The manifold ports P1 and P2 are connected to the ports of the cover actuator 35; the manifold port P3 is connected to the seal 63; and the ports P4 and P5 are connected to the two lock actuators 55. The lock and cover actuators 35 and 55 are all two-port actuators, so that the respective piston rods are positively extended and retracted by pneumatic pressure. Thus, one of the ports of the valves 85 and 87 are connected to the ports of the actuators 35 and 55 which cause the cover to open and the T-members to pivot open. Conversely, the other ports of the valves 85 and 87 are connected to the ports of the actuators 35 and 55 which cause the cover 9 to close and the T-members to pivot to their locked position.

Figure 10:
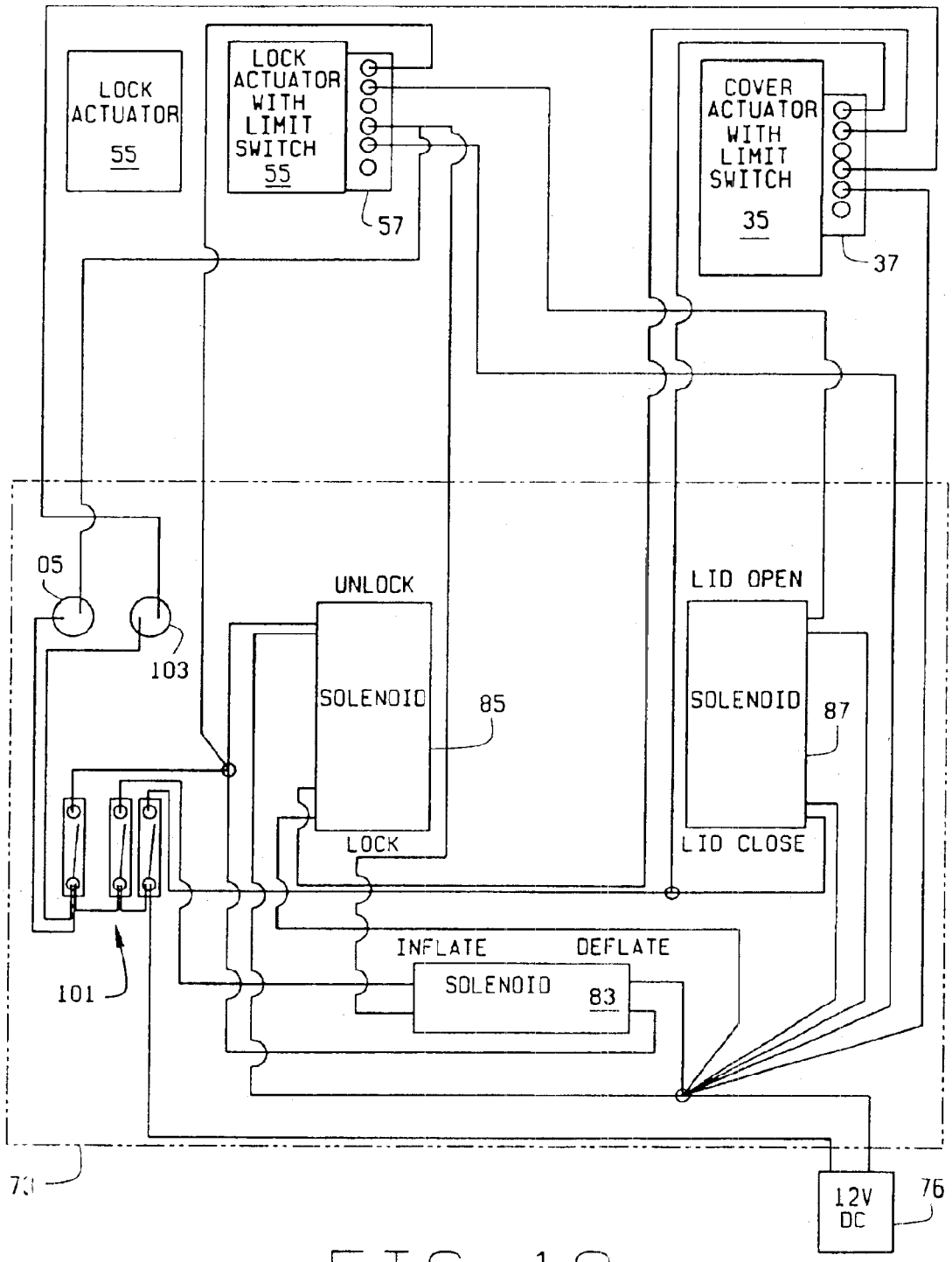
FIG. 10 is an electrical schematic of the control for the manhole cover.

The electrical schematic is shown in FIG. 10. The control box 73, as noted above, contains the valves 83, 85, and 87. It also contains a switch 101 which is a single throw-triple pole switch. The switch is movable between a first position to cause the cover to open and a second position to cause the cover to close and lock. The control box 73 also includes a pair of indicator lights 103 and 105. The switch 101, valves 83, 85, and 87, and the actuators are wired together as seen in FIG. 10 so that the elements operate in sequence. The limit switches 37 and 57 each transmit a signal to the controller indicative of the amount of rotation of the respective shafts (i.e., the lid shaft 21 and the lock shafts 50). Thus, the controller knows when the lid and lock arms are in their open (or closed) positions, and hence when it is time to signal the next event in the unlocking and opening of the lid or the closing and locking of the lid. Thus, with the cover closed and locked, when the switch 101 is moved to the "open" position, the valve 83 is activated to deflate the seal 63. As the seal is deflated, the cover 9 lowers slightly to allow the T-member 49 to disengage the locking flange 41. Once the seal 63 is deflated, a signal is sent to the actuators for the valve 85 to activate the actuators 55 to move the T-members 49 from their locked to unlocked positions. Then, a signal is sent to the actuators for the valve 87 to activate the actuator 35 to open the cover 9. Once the cover is opened, the "open" light 103 is turned on to indicate that the cover has been opened.

Conversely, when the cover 9 is to be closed, the switch 101 is moved to the closed position. This sends a signal to the actuators for the valve 87 to activate the actuator 35 to close the cover 9. Once the cover 9 is closed, a signal is sent to the actuators for the valve 85 to activate the actuators 55 to move the T-members from their unlocked to locked positions, in which the cross-bars 51 are received in the locking flange grooves 43. Once the T-members are in their locking position, a signal is sent to the valve 83 to inflate the seal 63. As the seal 63 inflates, it raises the cover 9 so that the T-member cross-bars will be positively received in the locking flange grooves 43, to prevent the T-members from becoming disengaged from the locking flanges 41. When the cover is closed and locked, the "close" light 105 is lit.

As noted, two actuators (i.e., solenoids) are associated with each of the valves 83, 85, and 87. Thus, for example, the valve 87 will remain in its open position after its open solenoid has been activated until the close solenoid is activated to move the valve 87 to the close position. Thus, should air or electricity ever be removed from the system for any reason, the valves will stay in the position they are in when air or electricity is lost.

Figure 11:
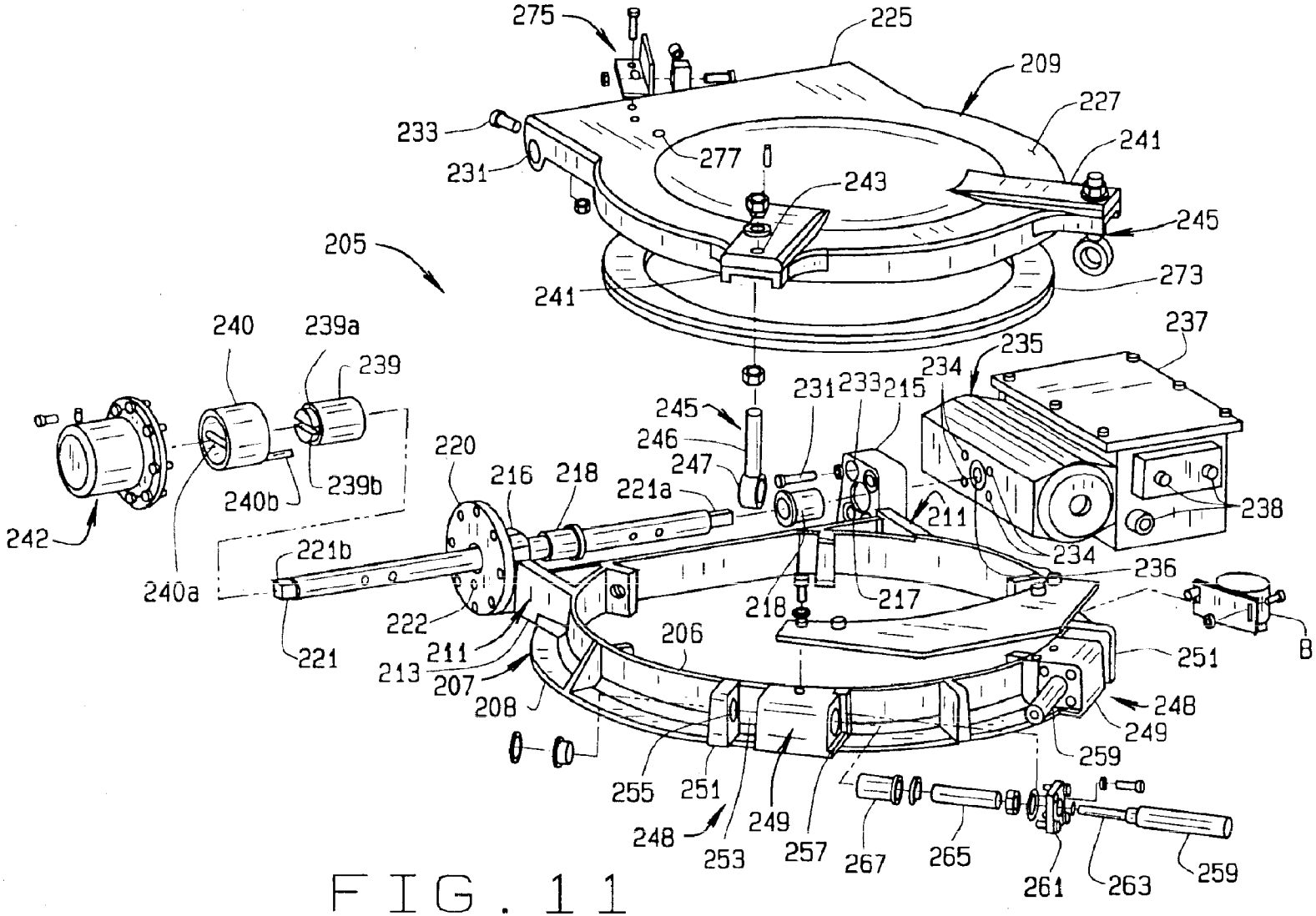
FIG. 11 is an exploded view of a second embodiment for the manhole cover.
Figure 12:
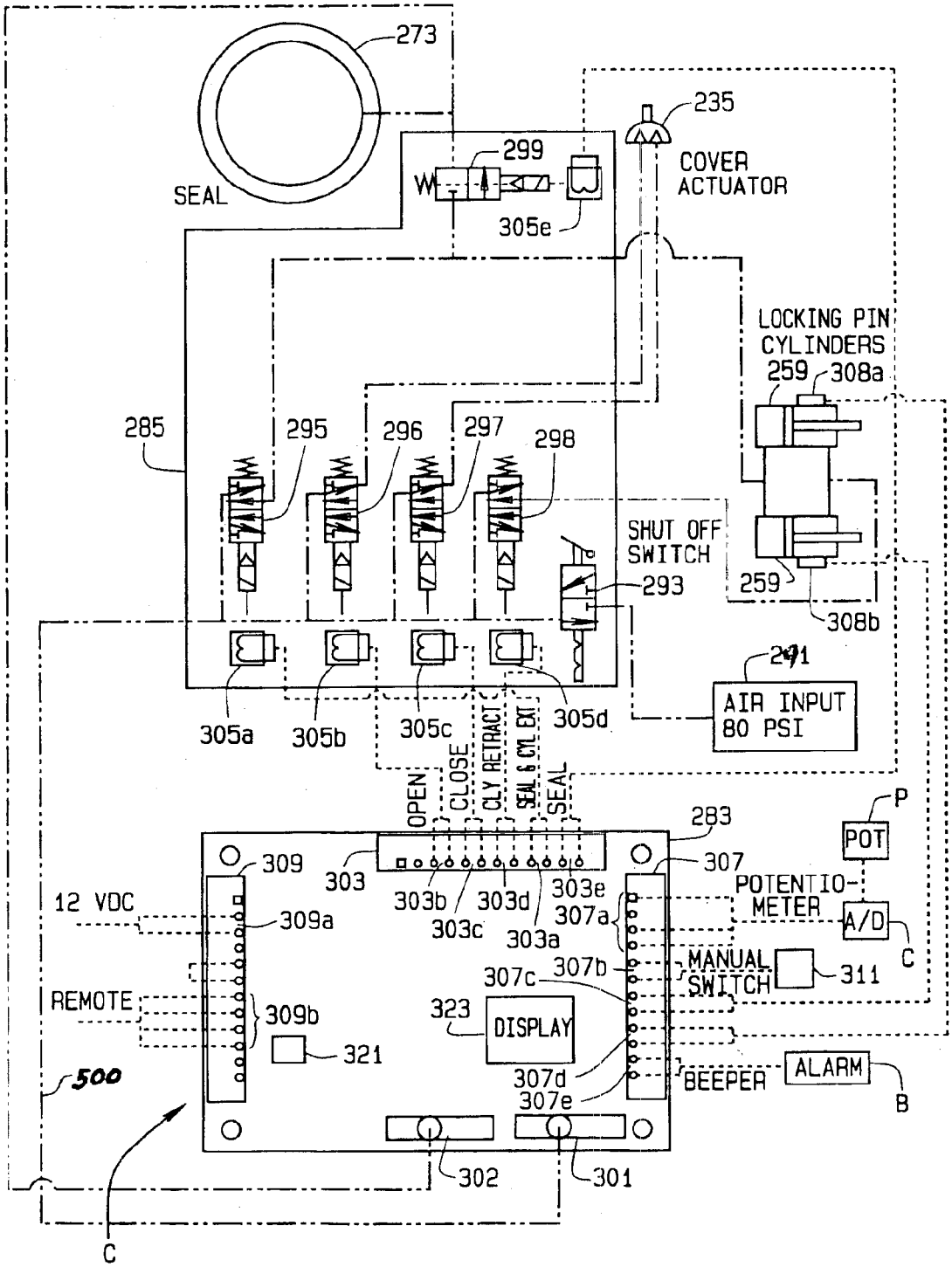
FIG. 12 is a pneumatic/electrical schematic for the manhole cover of FIG. 11.

A second illustrative embodiment of the remotely operated manhole cover is shown in FIGS. 11 and 12. The manhole cover assembly 205 includes a neck 207 which is mounted to the tanker. The neck 207 includes a cylinder 206 which extends up from a weld flange 208. The weld flange 208 is size and shaped to be secured to the tanker shell around the opening into the tanker chamber. The flange 208 can be secured to the tanker in any conventional manner, as long as there is a seal between the tanker and the flange. For example, the flange 208 can be welded or bolted to the tanker. A cover 209 is hingedly mounted to the manhole cover assembly 205 to be selectively movable between a closed position in which it covers the neck cylinder 206 to prevent access into the tanker, and an open position in which the cover is clear of the neck cylinder, the neck cylinder is opened, and materials can be loaded into the tanker, or workers can enter the tanker, for example, to clean the tanker. The cover 209 and the neck 207 are both preferably made from cast aluminum. The cover is preferably designed to withstand 25 psi working pressure and 45 psi test pressure if the vessel is pressurized.

A pair of brackets 211 extend rearwardly from the neck 207. The brackets 211 each include an arm 213 which extends rearwardly from the neck cylinder 206. A first journal box 215 is at the end of one of the arms 213 and a second journal box 216 is at the end of the other arm 213. The journal boxes 215 and 216 include openings 217. A shaft 221 rotatably extends between the journal boxes 215 and 216 and through the respective openings 217 in the journal boxes. Bearing sleeves 218 are provided in each journal box opening 217 through which the shaft 221 extends to facilitate rotation of the shaft 221 in the journal boxes 215 and 216.

A flange 220 is fixed to an outer surface of the journal box 216. The flange 220, which is circular in elevation, has a series of bolt holes around its periphery and a central opening through which the shaft 221 extends, and an inner hole 222 proximate the central opening of the plate.

The cover 209 includes a mounting flange 225 which extends rearwardly from the rim 227 of the cover 209. The mounting flange 225 includes journals 231 through which the shaft 221 extends. The mounting flange journals 231 are rotatably fixed to the shaft 221 by bolts 233 which extend radially through the journals 231 to engage the shaft 221. Thus the cover 209 and shaft 221 will rotate together, and the shaft 221 defines an axis of rotation for the cover 209.

A cover actuator 235 is mounted to the journal box 215 by bolts 231 which extend through bolt holes 233 in the journal box 215 and into bolt holes 234 in the housing of the actuator 235. The actuator 235 includes a keyed opening 236 (i.e., a square shaped opening) which receives a squared end 221*a* of the shaft 221. As will be described below, activation of the actuator 235 will cause the actuator to rotate the shaft 221 and hence move the cover 209 between its open and closed positions. The actuator 235 comprises two pistons attached to a rack and pinion (not shown) to which the keyed end 221*a* of the shaft 221 is operatively connected. Air is applied to the outside of both pistons or the inside of both pistons to make the rack move the pinion in a rotary motion. As the pinion rotates, the shaft 221 rotates to move the cover 209 between its opened and closed positions. One normally open pneumatic solenoid 296 (FIG. 12) is connected to the outside of the pistons and one normally open pneumatic solenoid 297 is connected to the inside of the pistons. Since both solenoids are normally open, the rotary actuator is charged with air all the time, and the circuit board controls the exhaust. Since both sides of the actuator are charged with the solenoid off, there is no danger of the cover opening or closing in a rapid manner at startup. The actuator solenoids 296, 297 are housed in an enclosure 237 having connections 238 for air supply lines. A potentiometer P (FIG. 12) can be positioned adjacent the shaft to monitor the position of the shaft 221 (and hence the position of the cover 209). Thus, the output from the potentiometer will provide information relating to the position of the cover. From this information, the rate of movement of the cover can also be determined.

A torsion spring mandrel 239 is mounted to the opposed end 221*b* of the shaft 221. The shaft end 221*b*, like the shaft end 221*a*, is squared, and is received in a square opening at the back of the mandrel 239 so that the mandrel is rotationally fixed relative to the shaft 221. The mandrel 239 includes a head 239*a* having a slot 239*b* extending across the surface of the head. A torsion spring 240 is journaled about the mandrel 239. The torsion spring has a radially extending arm 240*a* at one end and an axially extending arm 240*b* at its opposite end. The torsion spring radially extending arm 240*a* is received in the mandrel slot 239*b* and the torsion spring axially extending arm 240*b* is received in the hole 222 of the flange 220. A cover 242 encloses the torsion spring 240 and mandrel 239. The cover 242 is mounted to the flange 220 via a plurality of bolts which extend into the bolt holes in the flange 220. The torsion spring is mounted to the shaft 221 (via the mandrel 239) and to the journal housing 216 (via the flange 220) such that, when the cover 209 is at 90° (i.e., generally perpendicular to the tanker T), the torsion spring has no load. The load is applied to the torsion spring when the cover is in the open or closed position, and is used to offset the weight of the cover and to increase the life of the rotary actuator. The spring 240 also allows for better speed control when opening and closing the cover 209.

To lock the cover 209 in its closed position, the cover 209 includes a pair of arms 241 which extend out from the cover rim 227. Each arm 241 includes a bolt hole 243. An eyebolt 245 having a shaft 246 and an eye 247 is secured to the arm 241. The eyebolt shaft 247 has a threaded bore at its top end, and a bolt extends through the hole 243 in the cover arm 241 to secure the eyebolt to the arm 241. As seen in FIG. 11, the eyebolts 245 extend downwardly from the cover arms 241. Although an eyebolt is disclosed as part of the locking assembly, it will be appreciated from the discussion below, that the eyebolt could be replaced, for example, with bar stock having an opening corresponding to the opening 247 in the eye bolt.

A pair of lock assemblies 248 are mounted to the neck 207. The lock assemblies 248 engage the eyebolts 245 to hold and lock the cover 209 in its closed position. The lock assemblies 248 each include a cylinder housing 249 and a pin receiver 251 in a spaced apart relationship to define a gap 253. The gap 253 is sufficiently wide to receive the eyebolt eye 247. The housing 249 and receiver 251 are mounted and secured to the neck by securing the housing 249 and receiver 251 to the neck cylinder 208, the neck flange 208, or both, such as by welding, bolting, or by any other conventional means. The receiver 251 includes a hole 255 and the housing 249 includes a passage 257. The receiver hole 255 and housing passage 257 are aligned with each other.

A pin cylinder 259 is mounted to the cylinder housing 249 by a cylinder mounting plate 261 such that its pin or rod 263 extends into the housing passage. A locking pin 265 is secured to the cylinder pin 263 to be axially driven by the cylinder 259. The cylinder 259 drives the locking pin 265 between an extended position and a retracted position. In the extended position, the pin 265 extends through the housing passage 257, the gap 253, and the receiver hole 255. In the retracted position, the locking pin 265 is substantially contained within the housing passage 257. To facilitate movement of the rod 265 between its extended and retracted positions, sleeve bearings 267 are mounted in the housing passage 257 and the receiver hole 255.

The eyebolt 245 is positioned on the cover arm 241, and the eyebolt shaft is sized, such that the eyebolt eye 247 is aligned with the locking pin 265, the cylinder housing passage 257, and the pin receiver hole 255. The eyebolts 245 are threaded, and have clamping nuts. The threads allow for the eyebolts to be adjusted in the field if necessary, so that the eyebolt eyes 247 will be properly aligned with the locking pin 265. Thus, when the locking pin 265 is in its extended position, the locking pin 265 extends through the eyebolt eye 247. As can be appreciated, when the locking pin 265 is extended, the cover 209 is locked in its closed position. In the retracted position, the locking pin 265 is retained within the housing sufficiently to be clear of the eyebolt eye 247 to allow the cover to be moved to its raised position. Preferably, the eyebolt eye is ⅛" larger than the locking pin. The locking pin slides through the bronze bearings 267 to go through the eye, and then through a second bronze bearing in the pin retainer 251. The cylinders 259 which move the locking pins 265 are preferably only ¾" bore. They are small, so that if the tanker is pressurized, and the someone attempts to open the cover, they will not move because there is more frictional force from the eyebolts than axial force from the cylinders 259.

When the cover 209 is in its closed position, it is desirable to form a fluid and air tight seal between the cover 209 and the weld cylinder 7. To accomplish this, the cover 209 is provided with an inflatable annular seal 273, which is substantially identical to the seal 63 (FIGS. 7–8). The seal 273 is an elastomeric gasket with a rectangular cross-section and a hollow center. The hollow center is designed to give a 5/16" wall thickness all the way around the cross-section. A valve stem is attached to one side of the seal and extends through an opening 277 in the cover 209 for connection to a source of pressurized air. The cover 209 includes a pocket or groove, and, the seal 273 has a lip on its sides so that it wall snap into a mating groove on the cover. The legs of the pocket are as long as possible to minimize deflection when the seal is inflated. The seal is contained in the cover by three sides. One side of the seal will rest on a ¼" rolled ring surface on the vessel (i.e., the neck cylinder) when the cover is closed. The seal 273 is mounted to the underside of the cover 209 in the same manner described above with respect to the seal 63. The seal 273 is connected to an air supply over an air line, and can be inflated and deflated. A hose bracket 275 is mounted to the outside or top of the cover 209 to mount an air hose to the cover 209. The seal 273 has a stem (not shown) which extends through an opening 277 in the cover 209. A quick disconnect, for example, can be provided at the end of the stem to connect the air hose to the stem. When the seal 273 is deflated, the seal is generally rectangular in cross-section. When the lid 209 is locked and the seal is expanded and forms an air and fluid tight seal between the cover 209 and the weld ring 7. Additionally, as will be explained below, when the seal is inflated, the cover 209 is lifted slightly.

Figure 13:
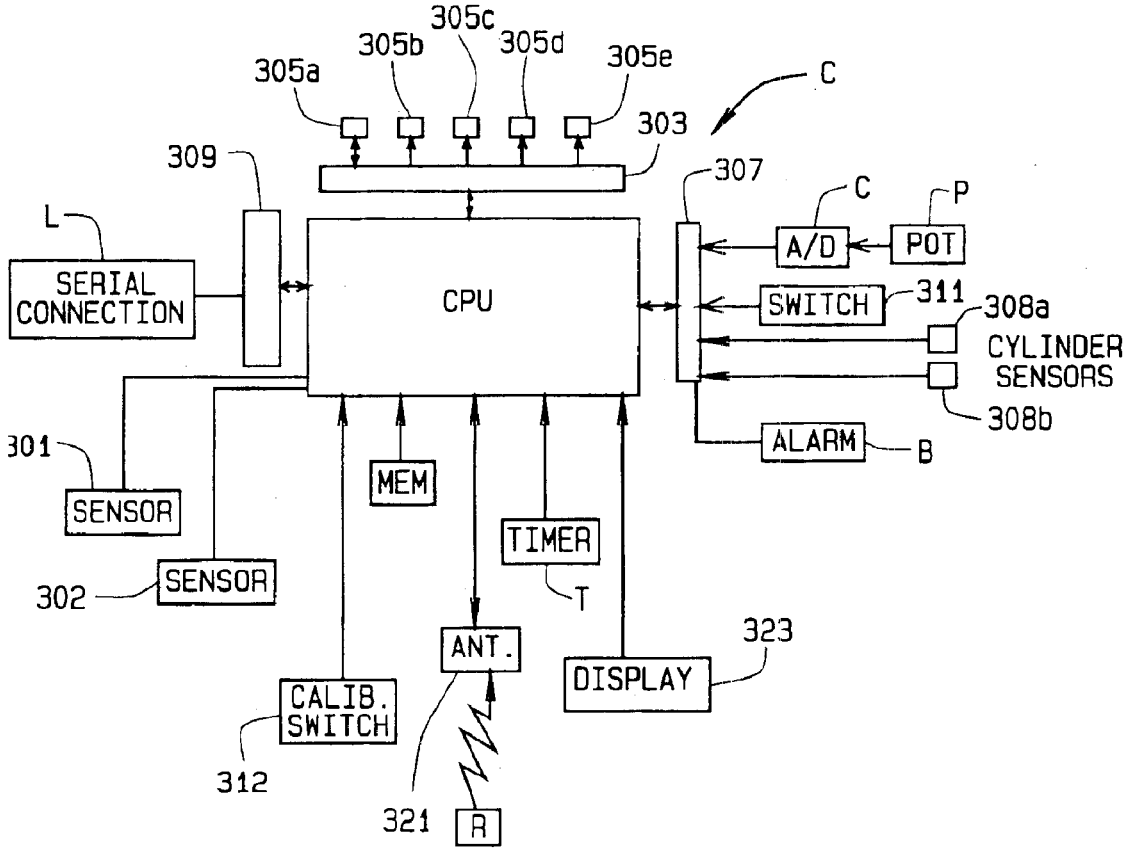
FIG. 13 is a block diagram of the control system shown in FIG. 12 for the manhole cover of FIG. 11.

An electrical/pneumatic schematic of the control system C for controlling the manhole cover assembly is shown in FIG. 12 and is shown in a block diagram in FIG. 13. The control system C for the manhole cover 209 includes a control box 500, incorporating a circuit board 283, which is mounted to the tanker T (See FIG. 12) at a level where it can be accessed by an operator standing on the ground and a valve manifold 285 which is mounted to the tanker T adjacent the cover 209. There is a valve manifold 285 for each cover 209 on the tanker T. The valve manifold 285 is connected to an air supply 291 via a shut off valve 293.

The valve manifold 285 includes five solenoid operated valves 295–299 which control air flow to the seal, locking pins, and rotary actuator. The valves 295–299 are all movable between an open position in which the respective. element of the cover assembly 205 is placed in communication with the air supply, as just noted, and a bleed position, in which pneumatic lines extending from the valves to the respective elements are opened to the atmosphere to allow the air in the respective elements to bleed off. The valves 295–299 are activated to move between their opened and bleed positions by relays 305*a–e*.

The valve 295, when opened, places the cylinders 259 in communication with the air supply to move the locking pins 265 to their extended position.

The valve 296, when opened, places the cover actuator 235 in communication with the air supply to move the cover 209 from its closed to its opened position. As discussed below, the potentiometer P is attached to the pivot shaft 221, and the system can determine the position of the cover from the resistance values of the potentiometer.

The valve 297, when opened, places the cover actuator 235 in communication with the air supply to move the cover 209 from its opened to its closed position.

The valve 298, when opened, places the cylinders 259 in communication with the air supply to move the locking pins 265 from their extended to their retracted positions. The valves 295 and 298 which retract and extend the locking pins 265 are three-way valves that normally go to exhaust. Thus, if power is lost from the circuit board 283, the locking pins will stay in their extended position.

Lastly, the valve 299, when opened, places the seal 273 in communication with the air supply to inflate the seal 273. The valve 299 is normally closed. If power is lost from the circuit board 283, the valve 299 will trap air in the seal 273 if the cover is closed and the seal inflated. This will provide a weather tight seal for the product in the tanker.

As can be appreciated, the valve 285 controls air pressure to both the seal 273 and the rotary actuator 235. This provides a combined relay for added seal and latch safety and security. The state of the control solenoids is such that when the system is latched and sealed, if the system looses power, the cover 209 will stay in its closed, latched and sealed position. This will allow the sealed trailer to be left without the tractor (and hence with out power) for an extended period of time. Thus, any product contained within the trailer will not escape.

To monitor the air pressure in the system, the circuit board 283 includes two pressure transducers or sensors 301 and 302. Pressure sensor 301 is in communication with the main pneumatic line of the valve manifold 285 to monitor pressure which is being supplied to the valves 295–299. The pressure sensor 302, on the other hand, is in communication with the seal 273, to monitor the pressure within the seal 273, so that the operator will know when the seal is properly inflated, or when it is deflated.

The circuit board 283 includes a CPU (FIG. 13) which controls the opening and closing of the cover 209 based on input received from the sensors 301 and 302 and the potentiometer P. To connect the circuit board to the various elements, the circuit board includes contact banks 303, 307, and 309. The contact bank 303 includes contacts 303*a–e* which place the CPU in communication with the relays 305*a–e*, respectively, to control the solenoid valves 295–299. Signals from the CPU to the various relays move the solenoid valves between their opened and bleed positions, as discussed below, to unseal, unlock and open the cover 209, or to close, lock, and seal the cover 209. The CPU is provided with non-volatile ram memory sufficient to enable the system to keep track of the logging of open/close times, logging of pressure, logging of temperature, logging of cycle time (i.e., the time required to open and close the cover), and logging of cycle failures.

The second contact bank 307 includes contacts 307*a–e*. Contacts 307*a* are connected to the potentiometer P to receive the output from the potentiometer via an A/D converter C. As noted above, the CPU uses the potentiometer output to monitor not only the position of the cover 209, but the rate of movement and acceleration of the cover 209.

The contacts 307*b* are connected to a manual switch 311, which when pressed activates the circuit board 283 to move the cover from its closed to its opened position, or vice versa. The switch 311 is preferably located near the manhole cover in the event there is a failure of the actuator system, or a technician is working on a cover.

The contacts 307*c* are connected to a sensor 308*a* on one of the cylinders 259; and the contacts 307*d* is connected to a sensor 308*b* on the other of the cylinders 259. The sensors 308*a,b* on the cylinders 259 emit a signal indicative of the position of the locking pin 265. Hence, from the signal emitted by the cylinder sensors, the CPU can determine if the locking pins 265 are fully extended, or if they are retracted. The control circuit includes a timer, and monitors the time the various activities take. If it takes too long to move the locking pins from their retracted to their extended positions, or vice versa, the control circuit will issue a warning on the display that, for example, the locking pins appear to be blocked. Based on the information from the locking pin sensors 308*a,b,* the CPU can control the cover actuator 235. Thus, for example, if the sensors 308*a,b* indicate that one (or both) of the locking pins 265 did not retract sufficiently, the CPU can abort the open cycle. Hence, the actuator 265 will not be activated to try and open the cover 209 when one or both of the locking pins 265 are still engaged with the eyebolt 245.

Lastly, the contact 307*e* is connected to a beeper or alarm B. The alarm is located near the manhole cover, and is sounded before the cover is unlocked and opened, and before the cover is closed and locked. This provides a warning to personnel who might be on the tanker that the cover is about to move, and gives them time to stand clear of the cover. Hence, upon beginning an open or close cycle, the CPU activates the alarm B, and, then waits a predetermined period of time before activating the cover actuator 235 to move the cover. This period, which can be, for example 15–30 seconds, gives personnel in the vicinity of the of the cover 209 to move away from the cover prior to movement of the cover.

The contact bank 309 has contacts 309*a* which are connected to a power supply, such as a 12 VDC power supply. Preferably, the system is provided with a resetable fuse to all of the user connections to prevent damage to the CPU and the circuitry of the control 283 if the unit is connected to excess voltage. A series of contacts 309*b* comprise a serial link, which allow the CPU to be operatively connected to, for example, another computer or another switch, which can be used to activate the system to open and close the cover. The serial connection, is preferably a serial RD-485 connector which allows for connection of external devices to the unit 283. Such external devices can be used to monitor system status, control lid and solenoid position, exercise the system by repeated action, diagnose problems in any element of the system, and download log information from the CPU.

Additionally, the circuit board 283 includes an antenna 321 which receives signals from a remote controller R. The remote controller R can be used to activate the system to open or close the cover 209. A display 323 provides various information, such as the position of the cover 209, the pressure in the air input line or in the seal 273, the position of the cylinders 259, etc. The display 323 also displays the inputs the system is waiting on to proceed to the next step during operation of the cover. Such information would inform the operator if there are any problems with any of the parts of the cover assembly 205. For example, if the control system is having difficulty moving the locking pins 265, the operator would be informed that the locking assemblies 248 need maintenance.

In operation, when the manhole cover 209 is in its closed position, the remote controller R is operated to send a signal to the CPU to open the cover. The signal is received by the antenna 321 and transmitted to the CPU. The switch 311 or remote 500 (See FIG. 12) can also be used to initiate an open or close cycle. When the CPU receives the signal to open the cover, it queries the potentiometer P to determine the location of the cover and the seal pressure sensor 302 to check the pressure in the seal. If the seal 273 is pressurized, the CPU signals the relay 305*e* to move the valve 299 from its opened to its bleed position to deflate the seal 273. The CPU then activates the actuator 235 to move the cover 209 down to move the eyebolts off the locking pins 265. With no force on the locking pins, the CPU signals the relays 305*a* and 305*d* to move the valve 295 to its bleed position and the valve 298 to its open position to move the rods 265 to their retracted positions, thereby removing the rods 265 from the eyebolts. When the locking pin sensors 308*a,b* indicate that the locking pins are retracted sufficiently, the CPU activates the solenoids 305*b* and 305*c* to move the valve 296 to its open position and to move the valve 297 to its bleed position to raise the cover 209. As noted above, the cover 209 pivots about the shaft 221. Via the potentiometer P, the CPU monitors the position of the cover 209, and when the cover is moved a full 180°, the CPU ceases sending signals to the relays 305*b* and *c* to stop movement of the cover 209. When the cover is opened 180°, the cover is laying flat against the vessel, leaving more room for loading.

To close the cover 209, the operator sends a signal to the CPU using either the remote controller R or the switch 311 or remote 500 (See FIG. 12), and the CPU does a reverse routine. The CPU checks the location of the cover, and then starts pulsing the valves 296 and 297 to move the cover to its closed position. When the cover is determined to be in the closed position (via information received from the potentiometer P), the CPU activates the valves 296, 297 to push the cover down. The CPU then activates the valves 295 and 298 to move the locking pins 265 to their extended positions, in which the pins 265 pass through the eyebolts and into the pin receiver 251. The CPU then activates the valve 299 to inflate the seal 273 to form a fluid and air tight seal between the cover 209 and weld ring 7. When the cover is closed and locked in place, and the seal is inflated, the seal will take up any variances in the surface of the rolled ring, and variances between the eyebolts and pins to create a pressure tight seal. To ensure a tight seal, the pressure within the seal must be at least 15 psi greater than the pressure within the tanker.

The system includes a timer T, and during an open or close cycle, the system monitors the time taken to complete a cycle. If the time to close or open exceeds a predetermined value, the system will time out and cancel the cycle. When this occurs, the system will provide a fault indicator and log a fault to the non-volatile memory M. The system can also provide for an audible indication that there was a fault in the cycle and display where the fault occurred on the display.

As can be appreciated, the R/F signal received from the remote control, the manual switch 311, and the remote switch located near the ground 500 (See FIG. 12) allow for three (3) different ways to activate the system to move the cover 209 between its open and closed positions.

As noted above, to open and close the cover, the CPU sends pulsed signals to the valves 296 and 297. It has been determined that by sending pulsed signals, the opening and closing of the cover 209 can be more carefully controlled. In order to achieve a slow and steady opening and closing of the cover 209, the CPU, using information received from the potentiometer P, tracks the acceleration of the lid to determine when the CPU needs to start reacting to a change in the acceleration. For example, when the cover starts accelerating too quickly, the pulse width combinations can be changed to slow down the rate of acceleration of the cover.

Power levels have been established that are achieved at different pulse width combinations, and these power levels are used to drive the lid proportionately. Similarly, braking levels for different pulse width combinations have been established and are used to brake the lid proportionately. The power and brake levels are calculated using three (3) different target speeds TS which are based on the lid position, and the direction of movement of the lid (i.e., opening or closing). Each target speed has a maximum above target ($TS_{MA}$) and a maximum below target ($TS_{MB}$). As noted above, the speed controller monitors the speed of movement of the lid, and the movement of the lid is decreased or increased to maintain the lid speed at the target speed. If the lid speed is below the target speed, power is incremented by a constant value or level (C); similarly, if the lid speed is above the target value, the power level is decremented by the constant level (C). If the cover speed is half way between the target sped and maximum-below-target speed, the power level is incremented by twice the constant value (2C); similarly, if the cover speed is half way between the target speed and maximum-above-target speed, the power level is decremented by twice the constant value (2C). When it is determined that the lid is moving at a speed equal to or greater than maximum above target (i.e, $TS_{MA}$), full braking is engaged to slow down the speed of the lid; when it is determined that the lid is moving at a speed equal to or less than maximum below target (i.e., $TS_{MB}$), maximum power is applied to increase the speed of the lid. The power/brake level to apply is determined every time the actuator is pulsed. The power/brake level applied to the lid is shown in the table below:

| Lid Speed (LS) | Power Level | Brake Level |
|---|---|---|
| LS < TS | C | |
| $TS_{MB}$ < LS < ½TS | 2 C | |
| LS * $TS_{MB}$ | Maximum Power | |
| LS > TS | | C |
| $TS_{MA}$ > LS > ½TS | | 2 C |
| LS ] $TS_{MA}$ | | Maximum Braking |

The power or braking level can be changed by increasing or decreasing the pressure in the pneumatic lines, or changing the rate of pulsing of the actuator 235. Thus, for example, the level C can be represented by a specific increase (or decrease) in the pressure in the pneumatic line, or a specific number of pulses per time period (i.e., minute). Hence, the level 2C would be equivalent to twice the pulsing rate or twice the pressure level in the pneumatic line. Further, maximum power (or braking) would be achieved by leaving the pneumatic lines open (i.e., eliminating pulsing, such that pressure is constantly applied to the actuator).

The control system also includes several other features. The system can be provided with a calibration switch 312. Upon powering up of the system, the calibration switch 312 can be activated to place the system in a calibration mode. In this mode, the cover 209 is closed, and the manual switch 311 is pressed. This calibrates the information received from the potentiometer with the cover in a closed position. The CPU can then use this calibrated information to more accurately determine the position of the cover during opening and closing operations. Additionally, each time the locking pins 265 are extended and the seal 273 is brought up to pressure, the calibration of the lid position is updated. This allows for the system to drift over time or temperature shifts and still stay calibrated.

Using the pressure sensor 301, the CPU can monitor the available air pressure from the air supply 291. If the air pressure is too low to complete an open/close cycle, the system can notify the operator on the display 323, by a message over the serial link L, by an audible or visible indication, or a combination of these means.

In monitoring the system (i.e., air pressure, seal inflation, lock pin position, and cover position) the system can provide an indication of a fault condition. Such an indication could be in the form of an audible alarm, a message on the display or serial link, or both.

As can be appreciated, the automatic manhole cover 205 can be operated from ground level. Thus, no one is required to climb on top of the tanker T to unlock and open, or to close and lock, the cover. Additionally, the inflatable seal 273 provides an air tight and fluid tight seal between the cover 209 and the weld ring 7. Because the seal is inflatable, if a groove is worn in the seal, it will not affect the seal between the cover 209 and the weld ring 7.

The manhole cover 205 essentially is made up of the cover 209 with eyebolts, the ring 207 with the locking pin assemblies 248, the rotary actuator 235 and torsion spring 240, and the enclosure containing the circuit board and the pneumatic solenoids. Hence, the manhole assembly 205 can be retrofitted onto an existing trailer. To retrofit an existing trailer, the existing manhole cover and all associated hardware must be removed. The existing cover hinges that were welded to the rolled ring that is part of the trailer are ground off. The manhole assembly 205 is then mounted to the trailer using lugs that are already on the trailer 's existing rolled weld ring. Then an 80 psi air supply and a 12 VDC power supply are added to power the system.

As various changes can be made in the above constructions without departing from the scope of the invention, it is intended that all matter contained in the above description or shown in the accompanying drawings shall be interpreted as illustrative and not in a limiting sense. For example, although the cover and locking actuators are disclosed to be pneumatic actuators, the actuators could also be electromagnetic actuators, hydraulic actuators, gear driven actuators, cam driven actuators, or any other type of actuator which can be operated to move the cover and the locking members 265. Although one switch is shown (and preferred) to activate the system, two separate switches could be provided, so that there would be one switch to activate the cover actuator and another switch to activate the lock actuators. The switch could be a push-button switch, rather than a flip switch. The T-members and the locking flanges of the assembly 5 can be reversed, such that the locking flanges 41 are on the weld ring 7 and the T-members 49 of the assembly 5 are on the cover 9. The T-members 49 of the assembly 5 can be replaced with any other pivotal member which can engage a locking flange to maintain the cover in its closed position. Although the tanker is described to include a weld ring on which the cover is pivotally mounted, the weld ring can be eliminated, and the cover can pivot relative to the tanker shell itself, and can seal about the opening in the tank shell. The potentiometer P can be replaced with any other type of sensor which can monitor the angular position of the cover or lid 209. Such other sensors could, for example, include a series of contacts on a plate in an arcuate pattern, the contacts, when activated, sending a signal to the CPU to indicate the angular position of said cover. These examples are merely illustrative.

What is claimed is:

1. A control unit for automatically opening and closing a manhole cover to a storage unit; said manhole cover including a lid mounted on said tank and being moveable between an open position and a closed position, a locking assembly moveable between a locked position in which said lid cannot be opened and an unlocked position in which said lid can be opened; and an inflatable/deflatable seal which is moveable between an inflated state to form a fluid tight seal between said lid and said storage unit when said lid is closed and a deflated state; said seal being in communication with a source of pressurized air; said control unit including:

a cover actuator operably connected to said lid to move said lid between its opened and closed positions;

a lock actuator operably connected to said locking assembly to move said locking assembly between its locked and unlocked positions;

a seal valve in communication with said seal and moveable between a first position in which said seal can be inflated and a second position in which said seal is deflated;

a control unit including a CPU in communication with said actuators and seal valve to operate said actuators and seal valve and a switch; said switch which, when activated begins an open cycle in which said actuators and seal valve are operated to deflate said seal, move said locking assembly to its unlocked position, and to move said cover to its open position or a close cycle in which said actuators and seal valve are operated to move said cover to its closed position, to move locking assembly to its locked position, and to inflate said seal.

2. The control unit of claim 1 including a cover position sensor; said cover position sensor emitting a cover position signal indicative of the angular position of said lid; said cover position signal being received by said CPU whereby said CPU can monitor the angular position of said lid.

3. The control unit of claim 2, wherein said CPU uses said cover position information to monitor the rate of movement of said cover and/or the acceleration of said cover.

4. The control unit of claim 3 wherein the CPU controls the cover actuator based on the rate of movement of said cover and/or the acceleration of said cover to maintain a substantially constant lid target speed as said lid is moved between its open and closed positions.

5. The control unit of claim 4 wherein said CPU emits pulsed signals to said cover actuator, said control unit changing the rate of pulsed signals to said cover actuator based on the lid speed; said rate of pulsed signals being increased when said lid speed is below the target speed, and said rate of pulsed signals being decreased when said lid speed is above the target speed.

6. The control unit of claim 1 including a locking assembly sensor; said locking assembly sensor emitting a lock position signal indicative of the position of said locking assembly; said locking assembly signal being received by said CPU.

7. The control unit of claim 6 wherein said CPU controls said cover actuator based on said lock signal, such that, said CPU aborts an open cycle if, after signaling said lock actuator to move said locking assembly to said unlocked position, said lock signal indicates that said locking assembly is still in said locked position.

8. The control unit of claim 1 including a seal pressure sensor in communication with said seal; said seal pressure sensor emitting a seal signal indicative of the pressure within said seal; said seal signal being received by said CPU.

9. The control unit of claim 1 wherein said cover and seal actuators are hydraulic or pneumatic actuators; said seal actuators being in communication with a source of pressurized are or hydraulic fluid over a control line; said control unit including a control line sensor in communication with said control line; said control line sensor emitting a control line pressure signal indicative of the pressure within said control line.

10. A remotely operated manhole cover assembly for a storage tank, the tank having a shell defining a chamber which receives flowable materials and an opening in said shell which is closed by said manhole cover; the manhole cover comprising:

a cover pivotable about an axis of rotation between a closed position in which said cover closes said tank opening and an open position in which said cover is substantially clear of said tank opening;

a cover actuator operatively connected to said cover to move said cover between its opened and closed positions;

a locking assembly having a first portion mounted to said cover and a second portion mounted to said tank shell; said locking assembly being movable between a locked position in which said first and second portions are engaged to hold said cover in its closed position and an unlocked position in which said first and second portions are disengaged to allow said cover to be moved to its opened position;

a lock actuator operatively connected locking assembly to move said locking assembly between its locked and unlocked positions; and a control unit in communication with said cover actuator and said lock actuator; said control unit activating said cover actuator and lock actuator in sequence to unlock and open said cover and to close and lock said cover; said control unit including a switch which activates said control unit to initiate an open cycle to open said cover or a close cycle to close said cover;

a hollow, generally tubular inflatable/deflatable seal in an underside of said cover; said seal forming a fluid tight seal between said cover and said tank opening; said manhole cover including an air supply line which is operably connectable to a source of air and is in communication with said inflatable seal; said seal being movable in response to signals from said control unit between an inflated state and a deflated state; and wherein said control unit includes a seal sensor in communication with said inflatable/deflatable seal; said seal emitting a signal which is received by said control unit indicative of the pressure within said seal.

11. The remotely operated manhole cover assembly of claim 10 wherein said actuators cover and lock actuators are pneumatically or hydraulically actuators; said cover assembly including control lines which operatively connect said cover and lock actuators to a source of pressurized air or hydraulic fluid; said control unit including a sensor in communication with said control lines for monitoring pressure of said pressurized air or hydraulic fluid in said control lines.

12. A remotely operated manhole cover assembly for a storage tank, the tank having a shell defining a chamber which receives flowable materials and an opening in said shell which is closed by said manhole cover; the manhole cover comprising:

a cover pivotable about an axis of rotation between a closed position in which said cover closes said tank opening and an open position in which said cover is substantially clear of said tank opening;

a cover actuator operatively connected to said cover to move said cover between its opened and closed positions;

a locking assembly having a first portion mounted to said cover and a second portion mounted to said tank shell; said locking assembly being movable between a locked position in which said first and second portions are engaged to hold said cover in its closed position and an unlocked position in which said first and second portions are disengaged to allow said cover to be moved to its opened position, said locking assembly first portion comprises a shaft extending from said cover and said locking assembly second portion comprises an axially movable locking pin; said locking pin being moveable between a locking position in which said pin engages said shaft and a second unlocking position in which said pin does not engage said shaft;

a lock actuator operatively connected locking assembly to move said locking assembly between its locked and unlocked positions; and a control unit in communication with said cover actuator and said lock actuator; said control unit activating said cover actuator and lock actuator in sequence to unlock and open said cover and to close and lock said cover; said control unit including a switch which activates said control unit to initiate an open cycle to open said cover or a close cycle to close said cover.

13. The remotely operated manhole cover assembly of claim 12 wherein said locking pin is mounted in a housing; said locking assembly further comprising a pin received spaced from said housing; said pin receiver and housing defining a gap which received said locking assembly shaft; said locking pin, when in its said locking position, extending through said locking assembly shaft and into said pin receiver.

14. A remotely operated manhole cover assembly for a storage tank, the tank having a shell defining a chamber which receives flowable materials and an opening in said shell which is closed by said manhole cover; the manhole cover comprising:

a cover pivotable about an axis of rotation between a closed position in which said cover closes said tank opening and an open position in which said cover is substantially clear of said tank opening;

a cover actuator operatively connected to said cover to move said cover between its opened and closed positions;

a locking assembly having a first portion mounted to said cover and a second portion mounted to said tank shell; said locking assembly being movable between a locked position in which said first and second portions are engaged to hold said cover in its closed position and an unlocked position in which said first and second portions are disengaged to allow said cover to be moved to its opened position;

a lock actuator operatively connected locking assembly to move said locking assembly between its locked and unlocked positions;

said manhole cover assembly including a shaft to which said cover is mounted, said shaft defining said axis of rotation for said cover; the manhole cover further including a torsion spring operatively connected to said shaft; said torsion spring imparting a force to said cover when said cover is in its closed position and when said cover is in its opened position; and a control unit in communication with said cover actuator and said lock actuator; said control unit activating said cover actuator and lock actuator in sequence to unlock and open said cover and to close and lock said cover; said control unit including a switch which activates said control unit to initiate an open cycle to open said cover or a close cycle to close said cover.

15. The remotely operated manhole cover assembly of claim 14 wherein said torsion spring is in an unloaded state when said cover is rotated approximately 90°.

16. A remotely operated manhole cover assembly for a storage tank, the tank having a shell defining a chamber which receives flowable materials and an opening in said shell which is closed by said manhole cover; the manhole cover comprising:

a cover pivotable about an axis of rotation between a closed position in which said cover closes said tank opening and an open position in which said cover is substantially clear of said tank opening;

a cover actuator operatively connected to said cover to move said cover between its opened and closed positions;

a locking assembly having a first portion mounted to said cover and a second portion mounted to said tank shell; said locking assembly being movable between a locked position in which said first and second portions are engaged to hold said cover in its closed position and an unlocked position in which said first and second portions are disengaged to allow said cover to be moved to its opened position;

a lock actuator operatively connected locking assembly to move said locking assembly between its locked and unlocked positions; a control unit in communication with said cover actuator and said lock actuator; said control unit activating said cover activator and lock activator in sequence to unlock and open said cover and to close and lock said cover; said control unit including a switch which activates said control unit to initiate an open cycle to open said cover or a close cycle to close said cover; and said manhole cover assembly including a sensor to monitor the position of said cover, said sensor outputting a signal received by said control unit, indicative of the radial position of said cover.

17. The remotely operated manhole cover of claim 16 wherein said cover sensor comprises a potentiometer.

18. The remotely operated manhole cover assembly of claim 16 wherein said control unit monitors the speed and acceleration of said cover when opening and closing.

* * * * *

UNITED STATES PATENT AND TRADEMARK OFFICE

CERTIFICATE OF CORRECTION

PATENT NO. : 6,952,996 B2
APPLICATION NO. : 10/190007
DATED : October 11, 2005
INVENTOR(S) : David E. Sisk It is certified that error appears in the above-identified patent and that said Letters Patent is hereby corrected as shown below:

Title page, item [73] Assignee, change “foundation” to --Formation--.

Signed and Sealed this

Thirtieth Day of June, 2009

JOHN DOLL
*Acting Director of the United States Patent and Trademark Office*